US005476631A

United States Patent [19]

Brown et al.

[11] Patent Number: 5,476,631

[45] Date of Patent: Dec. 19, 1995

[54] METHOD AND APPARATUS FOR ADAPTIVE POWDER FILL ADJUSTMENT ON POWDER METAL COMPACTING PRESSES

[75] Inventors: Richard S. Brown, Fairfield; William J. Molleran, Cincinnati, both of Ohio

[73] Assignee: Cincinnati Incorporated, Cincinnati, Ohio

[21] Appl. No.: 895,655

[22] Filed: Jun. 9, 1992

[51] Int. Cl.[6] ..... B22F 1/00

[52] U.S. Cl. ..... 419/38; 419/39; 419/66; 100/45; 100/49

[58] Field of Search ..... 417/38, 39, 66; 100/45, 49

[56] References Cited

U.S. PATENT DOCUMENTS

| | | | |
|---|---|---|---|
| 4,387,632 | 6/1983 | Heiberger | 100/45 |
| 4,938,673 | 7/1990 | Adrain | 419/23 |
| 5,250,255 | 10/1993 | Sagawa et al. | 419/39 |
| 5,275,740 | 1/1994 | Spyker et al. | 210/741 |

*Primary Examiner*—Peter A. Nelson
*Attorney, Agent, or Firm*—Frost & Jacobs

[57] ABSTRACT

An automatic adaptive fill cavity adjust system for a powder metal press to control trend variations in the weight of multi-level parts as the result of the flowability and apparent density characteristics of the powder metal. The system comprises a monitoring component to monitor compacting load or tonnage changes, or part weight changes. A computer control is provided to receive the monitor signals, to keep a running average of a small sample of parts, to execute the proper logic to determine when a fill adjustment is needed, and to calculate the new fill position for each moveable platen bearing a tooling member to assure that the percent change in powder column height is the same for all columns. The system further includes a motor drive component responsive to the control computer output to position the up stop of each moveable platen bearing a tooling member and the core rod mechanism (if used), to achieve proportionally correct adjustments to the fill cavity.

19 Claims, 6 Drawing Sheets

MEASUREMENT EVENT

FILL COMPENSATION

June 1992
01:30 PM

| Description | Top | Middle | Bottom | Core |
|---|---|---|---|---|
| Adjustment Mode | Auto | Auto | Off | Track |
| Program Fill Position | X.XXX | X.XXX | X.XXX | X.XXX |
| Measured Fill Position | X.XXX | X.XXX | X.XXX | X.XXX |
| Initial Fill Position | X.XXX | X.XXX | X.XXX | X.XXX |
| Total Adjustment | X.XXX | X.XXX | X.XXX | X.XXX |
| Maximum Adjustment | X.XXX | X.XXX | X.XXX | X.XXX |

| | | | | |
|---|---|---|---|---|
| Auto Compensate | off | | Teach Data Points | |
| Fill Multiplier | 1.00 | | | |
| dF/dT | 0.01212 | | Fill Mult. | Tonnage |
| Current Meas. | 41.7 | 1 | 1.02 | 43.4 |
| Meas. Avg. | 41.8 | 2 | 1.00 | 41.7 |
| Sample Size | 10 | 3 | 0.98 | 40.1 |
| Measurement Mode | Tonnage | | | |
| Lag | 5 | Expected Weight | | 275.00 |

FIG. 9

METHOD AND APPARATUS FOR ADAPTIVE POWDER FILL ADJUSTMENT ON POWDER METAL COMPACTING PRESSES

TECHNICAL FIELD

The invention relates to an automatic system for adaptive powder fill adjustment on a powder metal press to control trend variations in weight of multi-level parts as a result of the flowability and apparent density characteristics of the powder metal, and more particularly to such a system wherein the percent change in powder column height is the same for all columns.

BACKGROUND ART

In the typical powder metal compacting press, the die and lower tooling form a cavity into which the powder metal is deposited by an appropriate feed mechanism.

As is well known, a number of variables can affect the part weight for a given volume cavity. Such variables include feeder time over the die, mechanical action to the powder, geometry of the cavity, flowability of the powder and apparent density of the powder. Of the above variables, the first three are currently being controlled by good machine design and good tooling and part design. These three factors tend to affect the part-to-part weight variation but remain constant throughout a production run. Some part-to-part variation is unavoidable.

The present invention is primarily concerned with a trend variation. A trend variation, as opposed to a part-to-part variation, may be defined as a continuing shift of the average of the last ten tonnages away from the target tonnage. The selection of 10 tonnages is somewhat arbitrary and non-limiting, but has been found to be sufficient to determine the start of a trend variation. It is important to note that the trend variation may be determined in terms of a continuing shift of the average of the last 10 press tonnages away from the target press tonnage or as a continuing shift of the average of the part weight of the last 10 parts away from the target part weight. It has been found that there is a very strong linear relationship between press tonnage and part weight so that either can be used in the determination of a trend, as will be apparent hereinafter.

Of the above-named variables, flowability of the powder and apparent density of the powder are primary contributors to trend variation and are the most difficult to monitor and control before a part is made. It has long been known that powder metal flowing by gravity into a cavity will not always settle into the exact same apparent density. There are other factors which contribute to trend variation. These include die temperature change, the ambient temperature and the humidity, inconsistent head of powder in the final hopper systems, and source air starvation that changes platen motion.

Heretofore and up to the present time, reliance was placed on the operator to watch over the output of the press and to make as many adjustments as necessary to keep the part within specification limits. Added to the difficulty of this human monitoring, is the fact that when fill adjustments are called for, they are frequently incorrectly made for a multi-level part.

Proper fill adjustment is extremely important. The tool designer designs each tooling level to deflect to the same amount when the loads are balanced. Balanced loads and tool deflections are essential to a part that is to be free of powder shear cracks or ejection cracks and that is to have the proper densities. The set-up person spends a great deal of time setting up a multi-level job so as to arrange the fill on each level such that the loads on each punch are at specific tons per sqaure inch. A tooling level that sees a lower load than designed will leave its section of the part unsupported during ejection, which may cause the part to crack. The tool designer also designs the tooling so that various portions of the part will be characterized by the proper densities. Similarly, a tooling level that has a higher than designed load applied to it will leave the adjacent levels of the part unsupported during ejection, again possibly causing the part to crack. This critical balance and the proper densities are frequently lost during a production run because of improper fill adjustments causing the load balance to change between levels. Frequently, improper fill adjustments are made by varying the fill position of only one level. A fill adjustment for one level is fine for a single level part, but will often lead to difficulties with respect to a multi-level part. It is obviously not practical to expect an operator to calculate the proper fill adjustments necessary for each level each time a fill adjustment is required.

It is a primary object of the present invention to provide an automated system for determining when powder fill adjustments are required and to properly make these adjustments. To put in an automated system to monitor and control all of the variables which may contribute to trend variations would be extremely complex and cost prohibitive. The automated system of the present invention monitors the result and effect of these variables as reflected by weight changes in the compacted parts or compacting load changes which reflect such weight changes. The phrase "proportionately correct adjustments" is intended to mean adjusting the fill positions to retain the original relationship between each column of powder such that the percent change in powder column height is the same for all columns.

In recent times, part specifications continue to get tighter and tighter. At the same time, more presses are running unattended than ever before. As a result, it is believed that the system of the present invention fills a significant need in the industry.

DISCLOSURE OF THE INVENTION

According to the invention, there is provided an automatic, adaptive, fill cavity adjust system for a powder metal press to minimize trend variations in the weight of multi-level parts as a result of the flowability and apparent density characteristics of the powder metal. The system comprises three major components: a monitoring component, a computer control component, and a motor drive component for each of the fill adjustments.

The monitoring component monitors compacting load (tonnage) changes, or part weight changes.

The computer control component receives the monitoring component signals and keeps a running average of a small sample of parts. The computer control component executes the proper logic, determining when a fill adjustment is needed. It calculates a new fill multiplier and uses that to further calculate the new fill position for each platen bearing a tooling member, assuring that the percent change in powder column height is the same for all columns.

Each individual platen and the core rod mechanism has three modes of operation: OFF, AUTO and TRACK. The OFF mode is used for each platen to which no tooling member is mounted. The TRACK mode normally is used for the core rod mechanism and any platen that has core rods mounted on it so that they will match all adjustments made to the top platen, to keep the die/core rod relationship consistent. The AUTO mode may be used if the core rod or rods are intended to make blind holes. The AUTO mode is used for those platens carrying tooling so as to affect the same percentage change in each powder column.

The motor drive component comprises a motor drive for each up stop of each movable platen and the core rod mechanism. The motor drive component adjusts the vertical position of the up stop of each platen and the core rod mechanism, if required, in accordance with the output of the computer control component. The computer control component calculates exactly how much adjustment is necessary to bring the currect tonnage average or part weight average back to target.

BRIEF DESCRIPTION OF THE DRAWINGS

FIG. 9 illustrates the fill compensation screen with which the powder metal press is provided in accordance with the present invention.

DETAILED DESCRIPTION OF THE INVENTION

Figure 1:
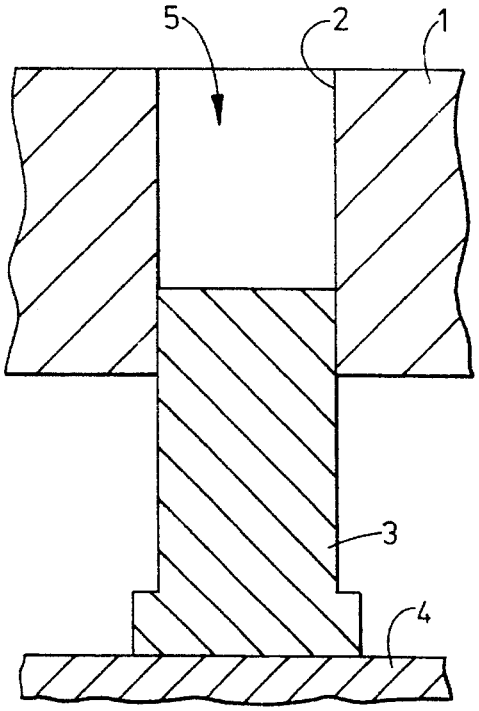
FIG. 1 is a fragmentary, semi-diagramatic, cross sectional view illustrating a die and a single lower punch defining the fill cavity for a single level part.

Reference is first made to FIG. 1 which illustrates a simple set-up involving a single lower punch for the manufacture of a simple cylindrical part, not of the multi-level type. A die is shown at 1. The die is mounted in the top platen (not shown) of the press. The die has a simple cylindrical bore 2 formed therein of a diameter equal to the diameter of the cylindrical part. The die 1 and its supporting top platen are shiftable vertically. The single lower punch 3 is a stationary punch mounted on a stationary support 4, of any appropriate type well known in the art. It will be noted that the stationary punch 3 is just nicely received within the bore 2 of die 1. The die 1 is vertically positioned in such a way that the upper end of fixed punch 3 and that portion of the die bore 2 thereabove define the fill cavity (generally indicated at 5) for the desired part to be made. The fill cavity 5 is loaded with powder metal by any appropriate means, such as the well known shuttle device (not shown) and thereafter the powder metal is compressed by an upper punch (not shown). The formed part is ejected from the fill cavity 5 and removed from the press, in preparation for the next part forming operation.

Figure 2:
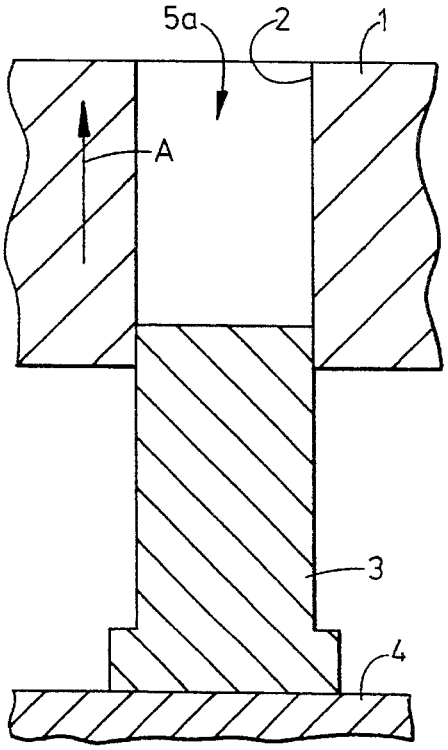
FIG. 2 is a fragmentary, semi-diagramatic, cross sectional view of the structure of FIG. 1, illustrating an exemplary adjustment for the fill cavity.

When it is found that there is a trend variation in the weight of the part or the overall load on the press frame (press tonnage), an adjustment in the size of the fill cavity is made. Assuming, for purposes of explanation, that the trend variation is such that the fill cavity 5 should be made larger, this can be done, as shown in FIG. 2, by simply raising the die 1 in the direction of arrow A to the proper new level. This will provide an adjusted fill cavity **5*a*** and maintain the desired press tonnage or part weight.

Figure 3:
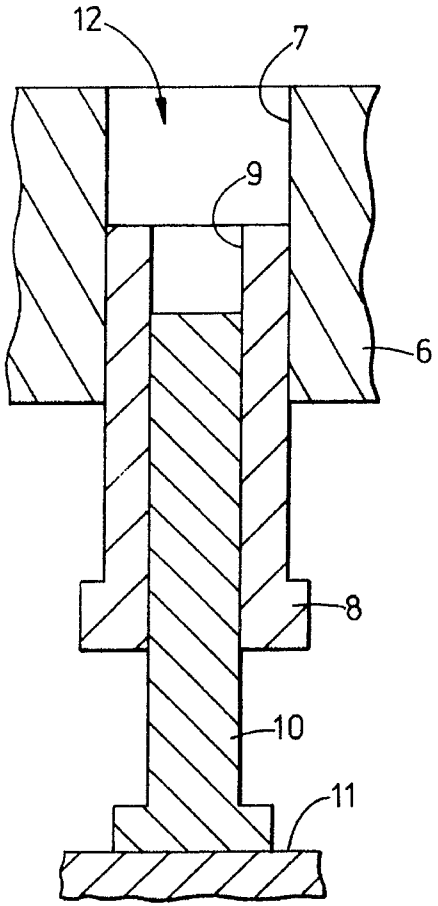
FIG. 3 is a fragmentary, semi-diagramatic, cross sectional view of a die and a movable lower punch and a fixed lower punch, defining a fill cavity for a multi-level part.

Reference is now made to FIG. 3 wherein a set-up is shown for the production of a multi-level part. It will be apparent that the part will have an upper cylindrical portion and a lower cylindrical portion of lesser diameter. To accomplish this, a die 6 is provided. The die will be supported in a top platen (not shown) and has a cylindrical bore 7 corresponding in diameter to the diameter of the upper portion of the part to be made. A middle punch 8 is just nicely received within the die bore 7. The middle punch 8 will be mounted on a middle platen (not shown). Both the die 6 and its top platen (not shown) and the middle punch 8 and its middle platen (not shown) are shiftable vertically. The middle punch is provided with an axial bore 9 of a diameter equal to the diameter of the lower portion of the part, and which just nicely receives a stationary punch 10 mounted on an appropriate stationary support 11. The fill cavity (generally indicated at 12) for the part to be made is defined by the upper end of stationary punch 10, and that portion of the bore 9 of middle punch 8 extending thereabove. The fill cavity 12 is further defined by the upper end of middle punch 8 and that portion of the die bore 7 extending thereabove.

When monitoring of press tonnage or part weight indicates that a trend variation is occuring, the fill cavity 12 should be changed to maintain the desired pressing tonnage or part weight. In prior art practice, it was usual only to shift the top platen (not shown) supporting the die 6. For purposes of an exemplary showing, let it again be assumed that the nature of the trend variation indicates that the fill cavity 12 should be enlarged. Again let the assumption be made that the die 6 and its top platen (not shown) are shifted upwardly in the direction of arrows A until the powder column height above the uppermost end of stationary punch 10 (indicated by the bracket P) is increased 20% in length. Since the middle punch 8 is not moved, the height of the annular powder column above the upper end of middle punch 8 (indicated by the bracket Q) is increased 33%. It will be immediately evident that the proper balance in the new fill cavity **12*a* has not been maintained and the parts may demonstrate cracking for the reasons given heretofore. In another way of putting it, fill volume above the stationary punch 10 has increased 20%, while the fill volume above the upper end of middle punch 8** has increased 33%.

Figure 5:
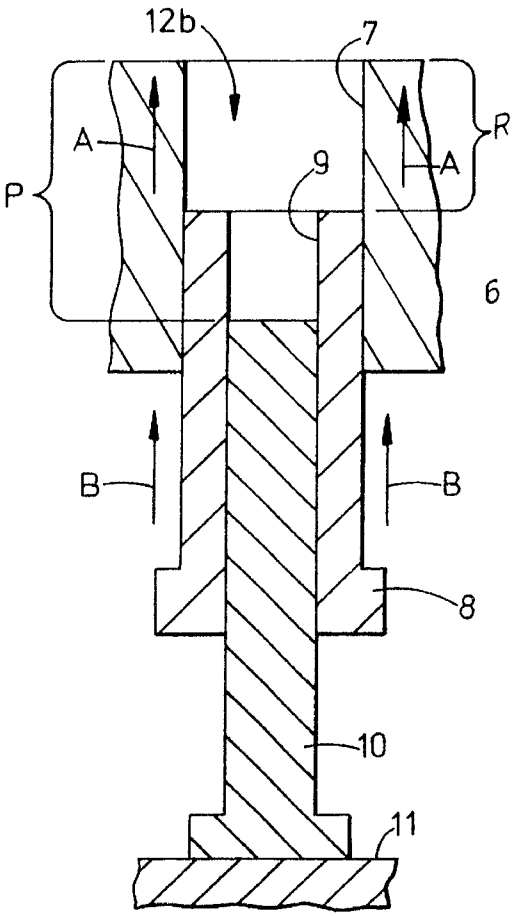
FIG. 5 is a fragmentary, semi-diagramatic, cross sectional view of the structure of FIG. 3, illustrating a correct fill adjustment to the fill cavity.
Figure 4:
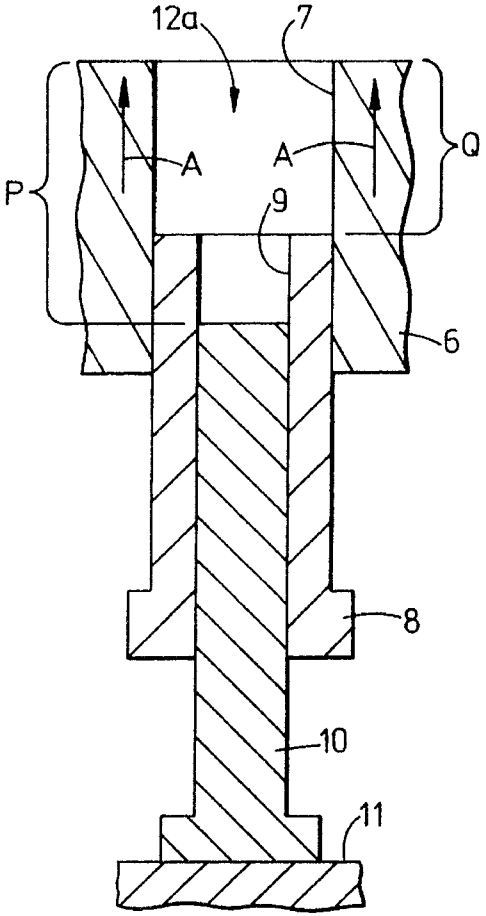
FIG. 4 is a fragmentary, semi-diagramatic, cross sectional view of the structure of FIG. 3 illustrating an incorrect fill adjustment of the fill cavity.

Reference is now made to FIG. 5 wherein the same apparatus is shown with the adjustment to the original fill cavity 12 (FIG. 3) having been properly made to create new fill cavity **12*b*. In this instance, the upper platen (not shown) and its die 6 have been moved upwardly in the direction of arrows A in the same manner shown in FIG. 4. This creates a powder column height above the upper end of stationary punch 10 (again indicated by bracket P) which is increased by 20%. In this instance, however, the middle punch 8 has also been shifted upwardly in the direction of arrows B. The middle punch 8 has shifted by a distance such that the height of the annular powder column above its upper end (indicated by bracket R) has also been increased by 20%. In other words, the fill volume above the upper end of stationary punch 10 and the fill volume above the upper end of middle punch 8 have both increased by the same amount, i.e. 20%. As a consequence, in FIG. 5** the fill cavity adjustment has been properly made in accordance with the present invention.

Figure 6:
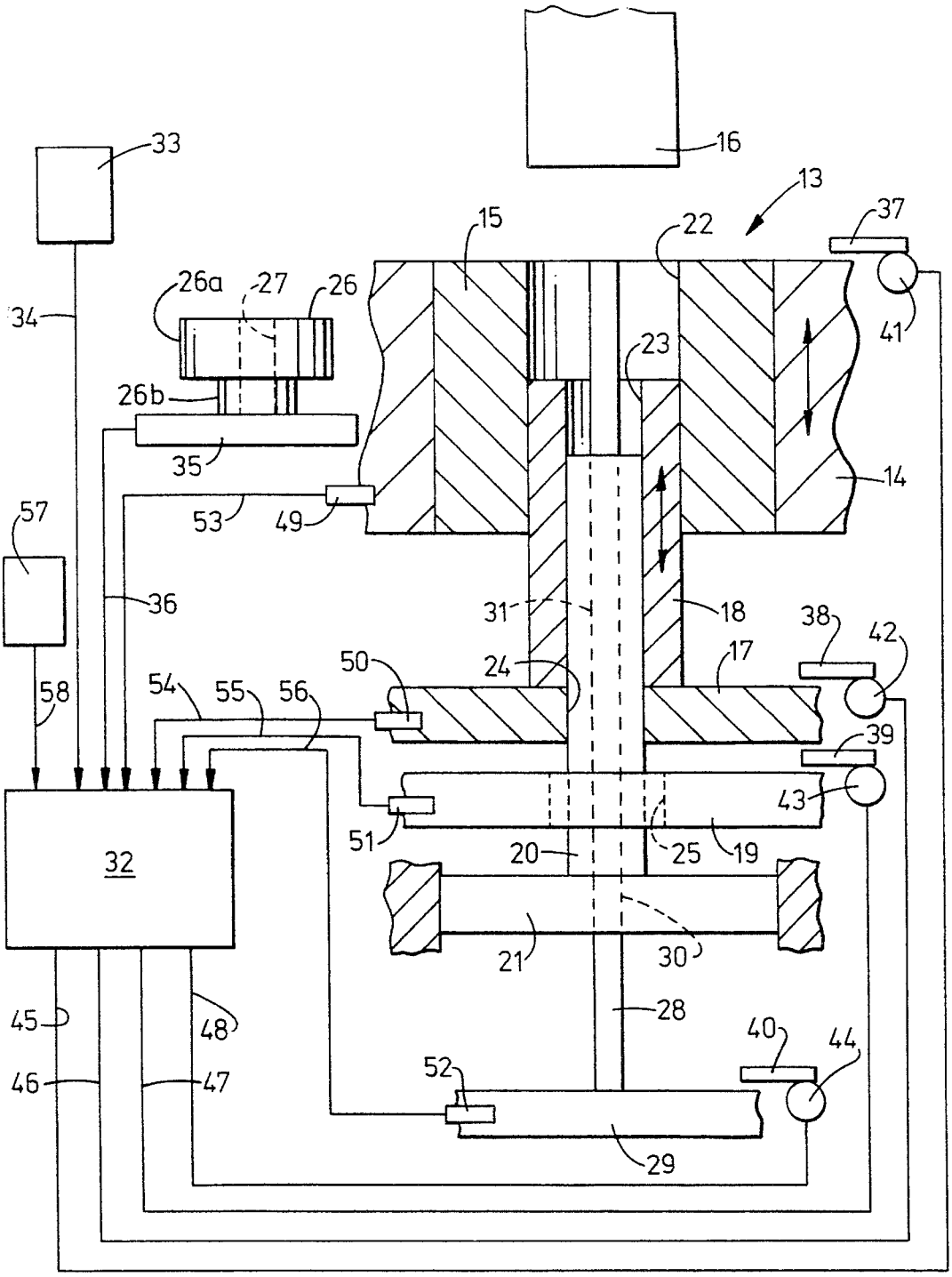
FIG. 6 is a fragmentary, diagramatic representation of a powder metal press with a fill cavity for a multi-level part the press being provided with the automatic, adaptive, fill cavity adjust system of the present invention.

Reference is now made to FIG. 6 wherein a powder metal press is fragmentarily and diagramatically shown. The powder metal press is generally indicated at 13. The press 13 is provided with a top platen 14 supporting a die 15. Above the die, the upper punch of the press is fragmentarily shown at 16.

The press 13 is provided with a middle platen 17, supporting a middle punch 18. A bottom platen is shown at 19 and a stationary punch is shown at 20 mounted on a stationary adaptor 21, as is well known in the art.

The die 15 has a cylindrical bore 22 formed therein. The external diameter of middle punch 18 is such that the middle punch is just nicely received within the die bore 22. The middle punch 18 has an axial bore 23. The outside diameter of the stationary punch 20 is such that it is slidably received within the axial bore 23 and a similar bore 24 formed in middle platen 17. The stationary punch 20 also passes through a bore 25 formed in bottom platen 19.

In the exemplary embodiment of FIG. 6, the press 13 is set-up to produce a multi-level powder metal part of the type shown at 26. The part 26 is exemplary only. The part 26 comprises an upper cylindricl portion **26*a* and a lower cylindrical portion 26*b*, the lower cylindrical portion 26*b* being of lesser diameter. The part 26 also has an axial bore 27 formed therein. The bore 27 is produced by means of core rod 28 mounted on core rod mechanism 29. The core rod extends with a sliding fit upwardly through a bore 30 in a stationary adaptor 21 and an axial bore 31 extending through stationary punch 20**.

The adaptive fill cavity adjust system of the present invention is diagramatically represented in FIG. 6. The system comprises a computer control component 32. The system further includes a monitoring component. The monitoring component may monitor the press tonnage or the weight of the parts. To monitor the press tonnage a strain cell 33 is appropriately mounted in a location on the press so as to monitor the overall load on the press frame. The strain cell 33 has an input to the computer control 32 as at 34. The monitoring component also includes a weighing device 35, located off-press, for weighing the individual parts. The weighing device 35 has an input 36 to the computer control 32.

The third major component of the adaptive fill cavity adjust system is the motor drive component for each of the fill adjustments. Each of the movable platens 14, 17, and 19, together with the core rod mechanism 29 is provided with an up stop shown at 37 through 40, respectively. Each of the up stops 37 through 40 is vertically shiftable and is provided with its own drive motor to shift the up stop. Up stops 37 through 40 are shown as having drive motors 41 through 44. The drive motors 41 through 44 are connected to the computer control outputs 45 through 48 respectively. Each of the movable platens 14, 17, and 19, together with the core rod mechanism 29 is provided with a position encoder 49 through 52, respectively. The position encoders 49 through 52 each have inputs to the computer control 32, indicated at 53 through 56, respectively. The position encoders 49 through 52 provide the computer with the exact positions of the movable platens 14, 17 and 19, as well as the core rod mechanism 29. In addition, means are provided for operator input such as set-up information and the like. This is indicated at 57 and is connected to the computer control 32 by input 58.

Each of the platens 14, 17 and 19, together with the core rod mechanism 29 has three modes of operation: OFF, AUTO and TRACK. The OFF mode is used when there is no tooling member mounted on that platen. In the exemplary embodiment illustrated in FIG. 6, bottom platen 19 is not being used and would be in the OFF mode. If, for example, the stationary punch 20 were mounted on a movable platen, rather than the stationary adaptor 21, that movable platen would be in the OFF mode so that both it and the stationary punch would indeed be stationary.

The AUTO mode serves to automatically adjust a movable platen to that level which will affect the same percentage change of its column of powder as the stationary column of powder. Finally, the TRACK mode is used for a through hole core rod, or any platen that has core rods mounted on it, this mode will match all adjustments made to the top platen 15 so as to keep the die/core rod relationship consistent. The computer control 32 calculates exactly how much adjustment is necessary to bring the current tonnage average or the part weight average back to target, as will next be described.

The computer control 32 will keep a running average of a small sample of parts (say 10 parts for purposes of an exemplary showing). If the current average deviates from the desired press tonnage or part weight by more than 10% of the part tolerance defined in press tonnage or part weight measurement, then an adjustment will be made. Another adjustment will not be made until a new sample is completed.

At start-up, the initial fill settings will be recorded when the part is brought to size and weight and is being properly produced. At this point, the fill multiplier will be set to 1.00. As will be noted hereinafter, the fill multiplier is used to change the height of each column of powder being adjusted. When the system determines that it is necessary to make an adjustment, the computer control 32 will modify the fill multiplier to bring the press tonnage or part weight back to the desired value. The formula for adjusting the fill multiplier to obtain a new fill multiplier via press tonnage is as follows:

new fill_mult=previous fill_mult* [1.0+dF/dT* (desired_tons-current_tonnage_average)]

Where:

new fill_mult is the new fill multiplier previous fill_mult is the old fill multiplier dF/dT is the rate of change of fill per change in tonnage (desired-tons-current_tonnage_average) is the tonnage correction The computer control 32 is provided with a teach mode which is used to determine dF/dT. The teach mode requires that three data points be entered. The first data point is the normal fill setting (1.0) and the average tonnage run at that fill level. Then the fill multiplier is increased slightly from 1.0 and an average tonnage is measured. Finally, the fill multiplier is decreased slightly below 1.0 and the tonnage is again measured. A curve is fitted to these data points and the slope of the curve at the center point 1.0 is used as dF/dT. dF/dT could be edited directly, if the operator knows how the job geometry and the apparent density of the powder will react, thus avoiding going through the teach mode procedure.

When part weight is used as the control value, the fill multiplier will be adjusted according the following formula:

new fill_mult = previous fill_mult* [1.0 + gain factor* (desired_weight-current_weight_average)/ desired_weight]

Where:

new fill_mult is the new fill multiplier previous fill_mult is the previous fill multiplier gain factor is a value between 0.5 and 1.0 to reduce compensation to prevent overshoot (desired_weight-current_weight) is the weight correction The factor dF/dT and the teach mode are not required when part weight is used as the control.

As indicated above, the fill multiplier is used to change the height of each column of powder being adjusted. The following formulas are used to calculate the adjusted fill positions where:

fill_muir is the fill multiplier tp_fill is the new top platen fill position mp_fill is the new middle platen fill position itp_fill is the initial top platen fill position imp_fill is the initial middle platen fill position For the column over the stationary punch:

tp_fill=itp_fill*fill_mult

The column over middle platen punch is really the difference in heights of the top and middle platen fill positions. This initial column height (itp_fill-imp_fill) is modified by the fill multiplier. The new height is subtracted from the new top platen fill position to obtain the new middle platen position.

mp_fill=tp_fill-[fill_mult* (itp_fill-imp fill)]

By substituting itp_fill* fill_muir for tp_fill, and reducing, the formula for the middle platen fill position is simply:

mp_fill=imp_fill*fill_mult

The same logic is applied to the bottom platen and core rod.

Overall changes to each fill position are recorded. The computer control imposes a maximum change on each platen. If the calculated change goes beyond the maximum change, the computer control will stop the press and indicate an error. The operator can bypass the overall maximum imposed by the computer control 32. Further, the operator can set his own maximum change, so long as it is less than the maximum change set by the computer control 32. As indicated above, when a part is produced and the tonnage is measured, the computer control 32 decides if and when it is time to make an adjustment. If an adjustment is to be made, the computer control 32 will wait until the press begins pressing the next part (i.e. until the press passes 135°). This guarantees that the fill adjustments will not be moving during the fill cycle.

FIG. 9 illustrates an exemplary fill compensation screen which may be associated with the press providing the operator with the pertinent information enabling him to perform proper set-up steps and maintain proper running of the press. In FIG. 9, the ADJUSTMENT MODE defines how each platen and the core assembly will respond to an adjustment signal. The top platen will always be in the AUTO mode. The other movable platens will also be in the AUTO mode if provided with a punch. In the exemplary embodiment illustrated in FIG. 6, the bottom platen 19 is not in use and would therefore be in the OFF mode, as indicated in FIG. 9. The core rod mechanism 29, if used, will normally be in the TRACK mode, assuming the same changes as the top platen. The core rod mechanism can be put in the AUTO mode if making a blind hole. The PROGRAMMED FILL POSITION indicates the position of the platens and core rod mechanism with which the press is currently running. The MEASURED FILL POSITION indicates the outputs of encoders 49 through 52 during the filling portion of the press cycle (see FIG. 6). The INITIAL FILL POSITION indicates the positions of the platen and the core rod mechanism fill stops at the outset of the run, when the first good parts are made. The TOTAL ADJUSTMENT records the total change in the fill positions of the platens and the core rod mechanisms since the last time the programmed fill position was set. The MAXIMUM ADJUSTMENT is the maximum change in fill position of the platens and the core rod mechanism allowed by the computer control 32. As indicated above, the press will stop if the AUTO fill adjustment mode calls for a change that exceeds this maximum.

It will further be noted that the screen indicates at AUTO COMPENSATE whether the automatic adjustment mode is ON or OFF. The FILL MULTIPLIER position indicates the fill multiplier currently in use. dF/dT shows the dF/dT value, which remains constant for the run. At the CURRENT MEASUREMENT position on the screen, the press tonnage or the part weight of the last part measured is given. At the MEASUREMENT AVERAGE position, the average of the press tonnage or part weight of the last sample of parts is shown. At the SAMPLE SIZE position of the screen, the number of parts constituting a sample to be averaged is displayed. At the MEASUREMENT MODE position, the screen will indicate whether press tonnage or part weight constitute the control measurements for the automatic adjustment. When part weight is being used for the controlled measurement, the LAG position on the screen will indicate the number of parts produced before a part is measured. This delays adjustments by the number of parts between the press and the scale 35.

As indicated above, when calculating dF/dT, the teach mode is used. The screen, at the TEACH DATA POINTS position, gives the three data points comprising a fill multiplier setting and an average tonnage for parts run at that setting. Further, as indicated above, these data points allow the computer control 32 to measure the tonnage response to a change in fill. Finally, at the EXPECTED WEIGHT position, the screen indicates the target weight value used when the adjustments are based on part weight.

The invention having been described in detail, the procedure for its use can now be set forth. The operator sets up the press to make a good part as usual. The adjustment mode values for each moveable platen and the core rod mechanism is set. The operator also selects the measurement mode, i.e. press tonnage or part weight. If part weight is used as the measurement mode, then the operator must activate the scale 35. When parts have been running properly and the press tonnage or the part weight is stable, the initial fill positions are set, the fill multiplier is set to 1.0 and the teach data point number 2 is set to the average of the sample (see FIG. 9). If part weight is being used, then the operator simply enters the spec weight.

If press tonnage is being used, the operator changes the fill multiplier to increase the fill slightly (i.e. to a value of 1.02, for an example). About 20 scrap parts are run and the fill multiplier and average tonnage for the last ten parts are recorded by the computer control 32 as the first data points under TEACH DATA POINTS. Thereafter, the operator will change the fill multiplier to decrease the fill slightly (i.e. to a value of 0.98, for example). After a run of about 20 scrap parts, the fill multiplier and average tonnage of the last 10 parts will be recorded by the computer control 32 as the third data points under TEACH DATA POINTS. Thereafter, the operator turns ON the auto compensate feature of the present invention and the computer control automatically resets the fill multiplier to 1.0, calculates the dF/dT, and restores the initial fill positions.

As indicated above, if the dF/dT value is already known, it can be directly entered, and the steps required for the calculation of dF/dT can be eliminated. Furthermore, if part weight is used rather than press tonnage, dF/dT is not required.

When the part is running properly and the fill compensation system is working, the set up should be stored in memory. The adjustment mode, the initial fill settings, and maximum adjustment values, the teach data points and dF/dT will be saved with the set up. If the job is rerun at a later date, these values will be loaded with the set up.

Figure 7:
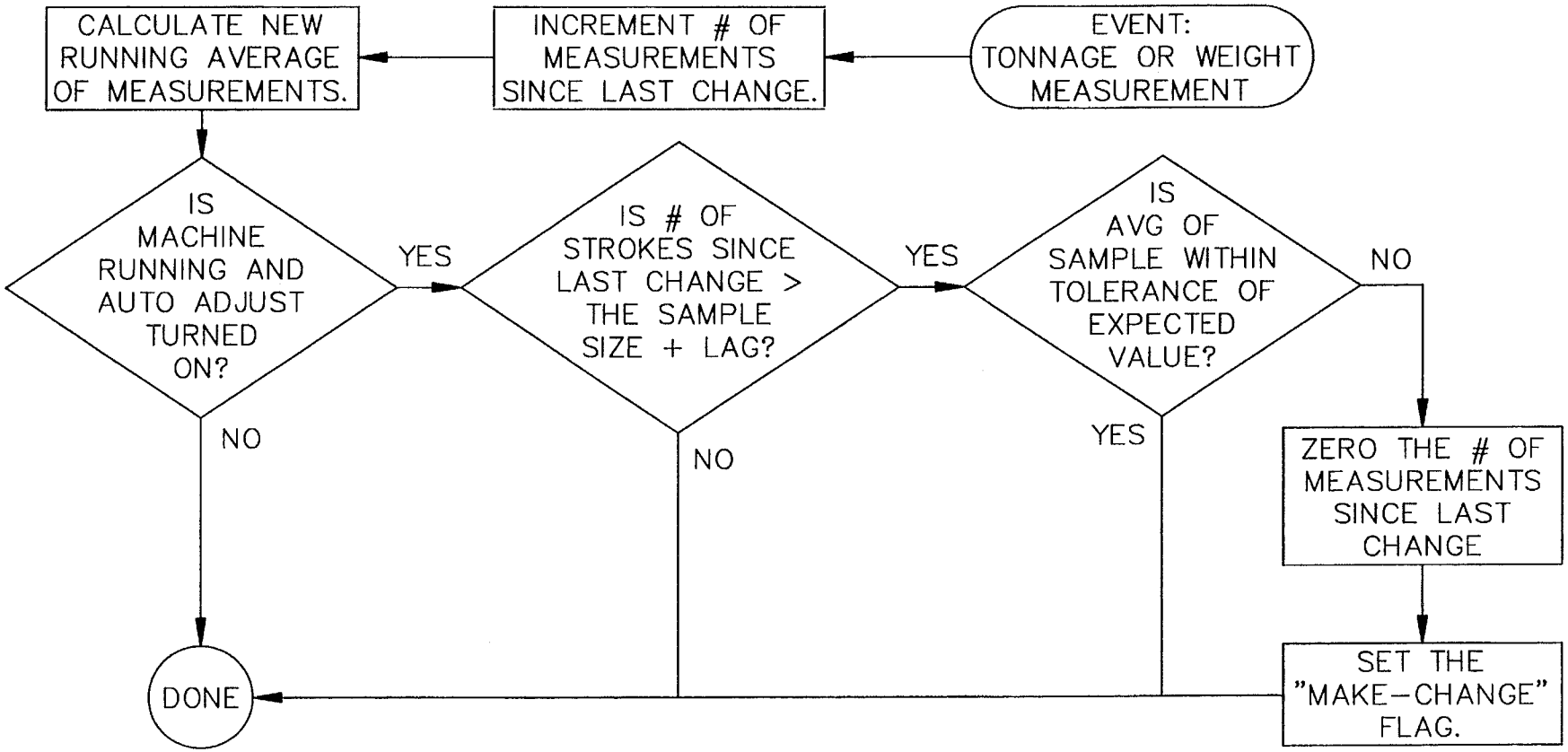
FIG. 7 is a flow chart illustrating the steps involved in the measurement event.

FIG. 7 is a flow chart illustrating a measurement event, the operator has preselected whether press tonnage or part weight will be measured. The number of measurements since the last adjustment was made are recorded. This assures that adjustments are not made too frequently. At every measurement of the press tonnage or part weight, a new running average of measurements is calculated. If the press is not running or the auto adjust system of the present invention is not turned on, the measurement event is over. If the press is running and the auto adjust system is on, then it is determined if the number of strokes since the last change is greater than the sample size. Where part weight is the determining factor, it is determined if the number of strokes since the last change is greater than the sample size plus lag. If the answer is no, then the measurement event is over. If the determination is affirmative, then the computer control 32 determines if the average of the sample part weights or press tonnages lies within the tolerance of the part. If the answer is yes, then the event is over. If the answer is no, the number of measurements since the last change is reset to zero and the "make-change" flag is set.

Figure 8:
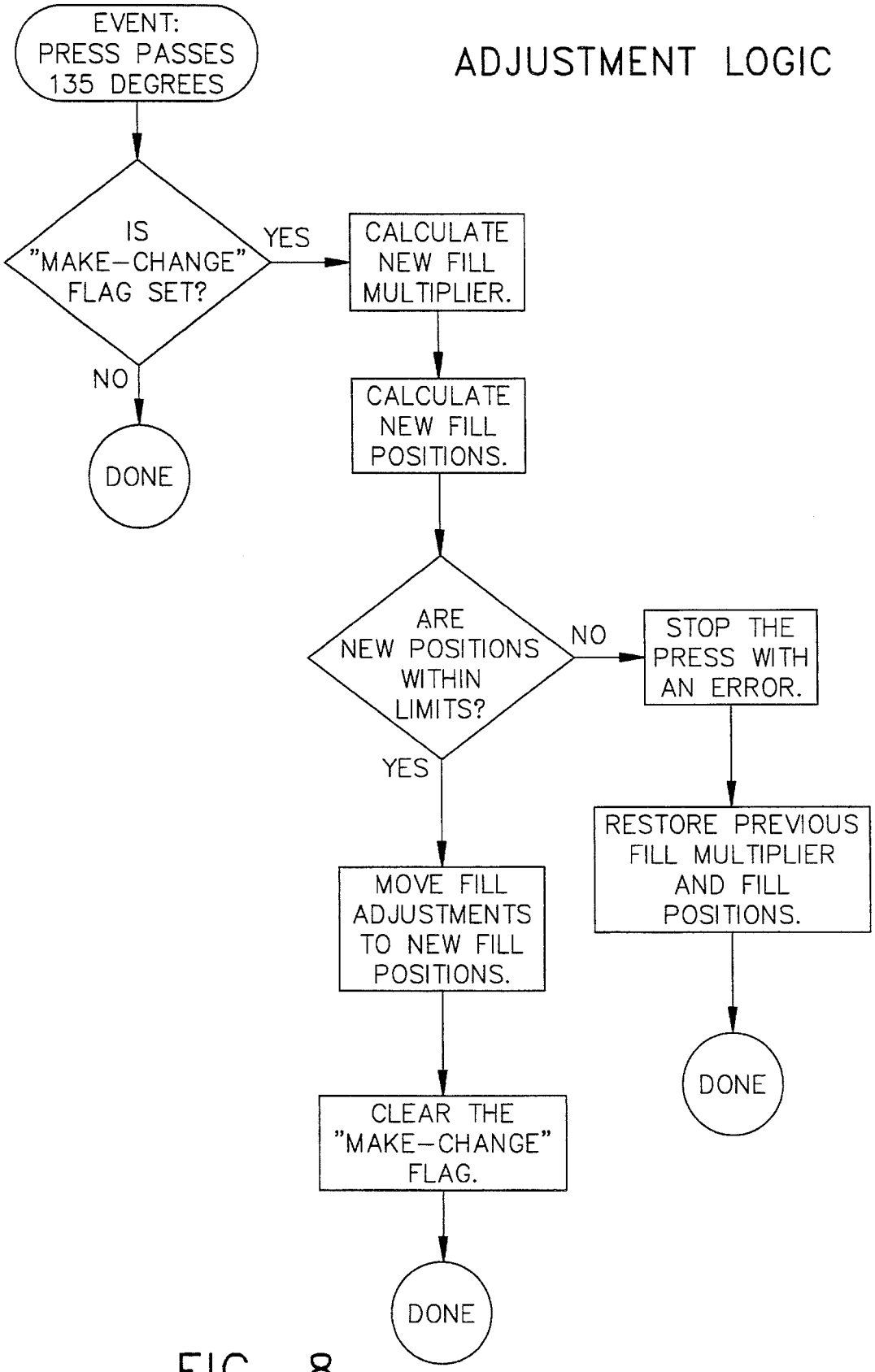
FIG. 8 is a flow chart illustrating the adjustment logic.

FIG. 8 is a flow chart illustrating the adjustment logic of the present invention. As indicated above, if an adjustment is to be made, the computer control 32 will wait until the press begins pressing the next part, thereby guaranteeing that adjustments will not be made during a fill cycle. The upper punch 16 begins pressing the next part when the press passes the 135° position. At this point, the computer control 32 determines if a "make-change" flag is set. If the answer is no, then the adjustment event is over. If the answer is yes, a new fill multiplier and new fill positions will be calculated as described above. It will then be determined if the new fill positions of the platens and the core rod mechanism are within the maximum limits set by the computer control 32 or those limits preset by the operator. If the answer is yes, the platens and the core rod mechanism will be shifted to their new positions, the "make-change" flag will be cleared and the adjustment event has been completed. If the new positions are not within the computer or operator imposed limits, then the press is stopped and an error is indicated. The previous fill multiplier and fill positions of the platens and core rod mechanism are restored, and the adjustment event is completed.

Modifications may be made in the invention without departing from the spirit of it.

What is claimed:

1. A method of automatically adjusting the fill cavity of a powder metal press to control trend variations in the weight of multi-level parts, wherein said fill cavity, when filled with powdered metal, has a plurality of powder column heights corresponsing to the various levels of the multi-level parts to be produced, comprising the steps of: determining the rate of change of fill per change in press tonnage dF/dT, monitoring the press tonnage as said parts are produced, keeping a running average of said tonnage for small samples each comprising a predetermined number of said parts, calculating a fill multiplier when a sample average exceeds a predetermined percentage of part tolerance, wherein said fill multiplier is calculated utilizing said dF/dT and the amount by which said sample average exceeds a predeteermined desired tonnage, calculating new fill positions for each tool bearing movable platen and the core rod mechanism if used utilizing said fill multiplier, such that the percent change in powder column height is the same for all powder columns, and positioning the up stop of each of said platens, and said core rod mechanism if used at said new fill positions to achieve a proportionally correct adjustment of said fill cavity.

2. The method claimed in claim 1 including the steps of providing three operating modes comprising OFF, AUTO and TRACK, placing said movable platens and said core rod mechanism in said OFF mode when no fill cavity adjustment is to be made, when a fill cavity adjustment is to be made, placing the top platen and said tool bearing movable platens in said AUTO mode to be shifted to said new fill positions, and setting said core rod mechanism if used and any movable platen supporting core rods to one of TRACK mode to assume the same changes as the top platen and AUTO mode if blind holes are to be made.

3. The method claimed in claim 1 including the step of preventing adjustment of said fill cavity during the fill cycle of said press.

4. The method claimed in claim 2 wherein said dF/dT is determined by establishing a first data point for the normal fill setting (1.0) and the average tonnage at that fill setting, establishing second and third data points at fill settings slightly higher and slightly lower than said normal setting and the average tonnages therefor, fitting a curve through said data points and determining the slope of the curve through said first data point as the value of dF/dT; wherein said fill multiplier is calculated by the formula:

new fill_mult=previous fill_mult*[1.0+dF/dT* (desired_tons-current_tonnage_average)]

where:

new fill_mult is the new fill multiplier, previous fill_mult is the old fill multiplier, (desired_tons-current_tonnage_avenge) is the tonnage correction, wherein the new position of the top punch is calculated by the formula:

tp_fill=itp_fill*fill_mult where:

tp_fill is the new top platen fill position, itp_fill is the initial top platen fill position, fill_mult is the new fill multiplier, wherein the new position for the middle platent is calculated using the formula mp_fill=imp_fill*fill_mult where:

mp_fill is the new middle platen fill position, imp_fill is the intial middle platen fill position, fill_mult is the new fill multiplier, and wherein the positions of the other movable tool carrying platens and the core rod mechanism if used are determined by calculations of the same type used to determine said new position of said middle platen.

5. A method of automatically adjusting the fill cavity of a powder metal press to control trend variations in the weight of multi-level pans, wherein said fill cavity, when filled with powdered metal, has a plurality of powder column heights corresponsing to the various levels of the multi-level pans to be produced, comprising the steps of: monitoring the part weight as said parts are produced, keeping a running average of said part weight for small samples each comprising a predetermined number of said parts, calculating a fill multiplier when a sample average exceeds a predetermined percentage of part tolerance, wherein said fill multiplier is calculated utilizing the amount by which said sample average exceeds a predetermined desired tonnage, calculating new fill positions for each tool bearing movable platen and the core rod mechanism if used utilizing said fill multiplier, such that the percent change in powder column height is the same for all powder columns, and positioning the up stop of each of said platens, and said core rod mechanism if used at said new fill positions to achieve a proportionally correct adjustment of said fill cavity.

6. The method claimed in claim 4 including the step of establishing maximum fill position changes, and stopping the press if the new calculated fill positions exceed said maximum fill position changes.

7. The method claimed in claim 5 including the step of establishing maximum fill position changes, and stopping the press if the new calculated fill positions exceed said maximum fill position changes.

8. The method claimed in claim 5 including the step of providing a scale, transferring said parts from said die to said scale in a tandem row, using said scale to determine the weight of each part, and delaying fill position changes by the number of parts between the die and the scale.

9. An automatic adaptive fill cavity adjust system for a powder metal press to control trend variations in the weight of multi-level parts, said press comprising a movable top platen, a die mounted in said top platen, additional movable platens therebeneath, a punch mounted on at least one of said additional platens, a stationary punch and a stationary support therefor, and an up stop for each of said top platen and said additional movable platens determining the vertical positions thereof, said system comprising monitoring means for monitoring one of press tonnage change and part weight change, said system further comprising a computer control means for keeping a running average of said change for small samples each comprising a predetermined number of said parts, for determining when an adjustment of said fill cavity is required, and for calculating new fill positions for said top platen and each punch bearing movable platen such that the percent change of power column height over each punch is the same, said system also comprising motor drive means controlled by said computer control means for vertically shifting each of said up stops of said top platen and each of said punch bearing movable platens to cause said platens to achieve their new fill positions in accordance with said newly calculated fill positions.

10. The fill cavity adjust system claimed in claim 9 wherein said powder metal press comprises a frame, said monitoring means comprising a strain cell mounted on said frame to monitor the overall load thereon, said strain cell having an input to said computer control means.

11. The fill cavity adjust system claimed in claim 9 wherein said monitoring means comprises a weigh scale mounted off-press for weighing each of said powder metal parts, said weigh scale having an input to said computer control means.

12. The fill cavity adjust system claimed in claim 9 wherein each of said top platen and said movable platens is provided with a position encoder having an input to said computer control means.

13. The fill cavity adjust system claimed in claim 9 including a core rod mounted on a core rod mechanism, an up stop for said core rod mechanism, said core rod mechanism upstop being vertically shiftable by said motor drive means.

14. The fill cavity adjust system claimed in claim 9 wherein said motor drive means comprises a drive motor for each of said up stops.

15. The fill cavity adjust system claimed in claim 13 wherein each of said top platen, said movable platens, and said core rod mechanism is provided with a position encoder having an input to said computer control means.

16. The fill cavity adjust system claimed in claim 15 wherein said motor drive means comprises a drive motor for each of said up stops.

17. The method claimed in claim 5 wherein said fill multiplier is calculated by the formula:

new fill_mult = old fill_mult* [1.0 + gain factor*(desired_weight_current_weight_average)/ desired weight]

where:

new fill_muir is the new fill multiplier, old fill_muir is the previous fill multiplier, desired_weight is the spec weight, (desired_weight-current_weight _average is the weight correction, wherein the new position of the top punch is calculated by the formula:

tp_fill=itp_fill*fill_mult where:

tp_fill is the new top platen fill position, itp_fill is the initial top platen fill position, fill_mult is the new fill multiplier, wherein the new position for the middle platen is calculated using the formula mp_fill=imp_fill*fill_mult where:

mp_fill is the new middle platen fill position, imp_fill is the initial middle platen fill position, fill_mult is the new fill multiplier, and wherein the positions of the other movable tool carrying platens and the core rod mechanism if used are determined by calculations of the same type used to determine said new position of said middle platen.

18. The method claimed in claim 17 including the steps of providing three operating modes comprising OFF, AUTO and TRACK, placing said movable platens and said core rod mechanism in said OFF mode when no fill cavity adjustment is to be made, when a fill cavity adjustment is to be made, placing the top platen and said tool bearing movable platens in said AUTO mode to be shifted to said new fill positions, and setting said core rod mechanism if used and any movable platen supporting core rods to one of TRACK mode to assume the same changes as the top platen and AUTO mode if blind holes are to be made.

19. The method claimed in claim 17 including the step of preventing adjustment of said fill cavity during the fill cycle of said press.

* * * * *

UNITED STATES PATENT AND TRADEMARK OFFICE

CERTIFICATE OF CORRECTION

PATENT NO. : 5,476,631

DATED : December 19, 1995

INVENTOR(S) : Richard S. Brown, William J. Molleran

It is certified that error appears in the above-indentified patent and that said Letters Patent is hereby corrected as shown below:

Column 10, line 49, (claim 4) "avenge" should read --average--.

Column 11, line 7, (claim 5) "pans" should read --parts --.

Column 11, line 9, (claim 5) "pans" should read --parts--.

Column 12, line 42 (claim 17)in first and second occurrences "muir" should read--mult--

Signed and Sealed this

Twenty-seventh Day of August, 1996

*Attest:*

Bruce Lehman

BRUCE LEHMAN

*Attesting Officer*

*Commissioner of Patents and Trademarks*